United States Patent [19]

Groos et al.

[11] Patent Number: 4,995,253

[45] Date of Patent: Feb. 26, 1991

[54] METHOD FOR TAKING UP A BILLET PRODUCED IN THE EXTRUSION OR TUBE-MAKING PRESS AND CONTROL OF A TAKE-UP DEVICE FOR THIS PURPOSE

[75] Inventors: Horst Groos, Mettmann; Karl-Heinz Schütte, Kaarst, both of Fed. Rep. of Germany

[73] Assignees: SMS Sutton, Inc., Pittsburgh, Pa.; SMS Hasenclever GmbH, Dusseldorf, Fed. Rep. of Germany; a part interest

[21] Appl. No.: 327,809

[22] PCT Filed: Jul. 18, 1988

[86] PCT No.: PCT/DE88/00439

§ 371 Date: Mar. 17, 1989

§ 102(e) Date: Mar. 17, 1989

[30] Foreign Application Priority Data

Jul. 18, 1987 [DE] Fed. Rep. of Germany ..... 3723824

[51] Int. Cl.[5] ..... B21C 35/02

[52] U.S. Cl. ..... 72/257

[58] Field of Search ..... 72/257, 290

[56] References Cited

U.S. PATENT DOCUMENTS 4,635,459 1/1987 Elhaus ..... 72/257

FOREIGN PATENT DOCUMENTS 180611 8/1986 Japan ..... 72/257

*Primary Examiner*—Lowell A. Larson

*Attorney, Agent, or Firm*—Fleit, Jacobson, Cohn, Price, Holman & Stern

[57] ABSTRACT

Method, control, and apparatus for taking up a billet produced in an extrusion or tube-making press includes applying a controlled pull-away tractive force, which keeps the emerging billet straight and does not affect the formation of the billet, increasing the pull-away tractive force in proportion to the extruded billet length, unit length weight and coefficient of friction between the billet and the delivery table, superimposing the pull-away tractive force upon the take-up tractive force determined from the cross-section and flow behavior in the die. After a billet has been separated and withdrawn from the die, the pull-away force and the length of the emerging billet are measured and the pull-away force, divided by the billet length, is entered as a set value for the specific profile frictional force to be multiplied by the billet length, which is determined by a path measurement, when extruding a subsequent billet of the same nominal cross section. The control is carried out such that, in addition to a value, which takes account of the resistance to motion of the carriage of the take-up device, as a first addend, and in addition to a base value—dependent upon the billet cross-section—of the take-up force as a second addend, starting from the point at which the billet tip is gripped by the grippers of the take-up device, an increasing value, which is the respective product of the result of a continuous delivery path measurement and a predetermined specific profile frictional force between the emerging billet and the delivery table, is determined and entered as a third addend as a desired value of the tractive force exerted on the billet tip.

9 Claims, 4 Drawing Sheets

FIG. 1
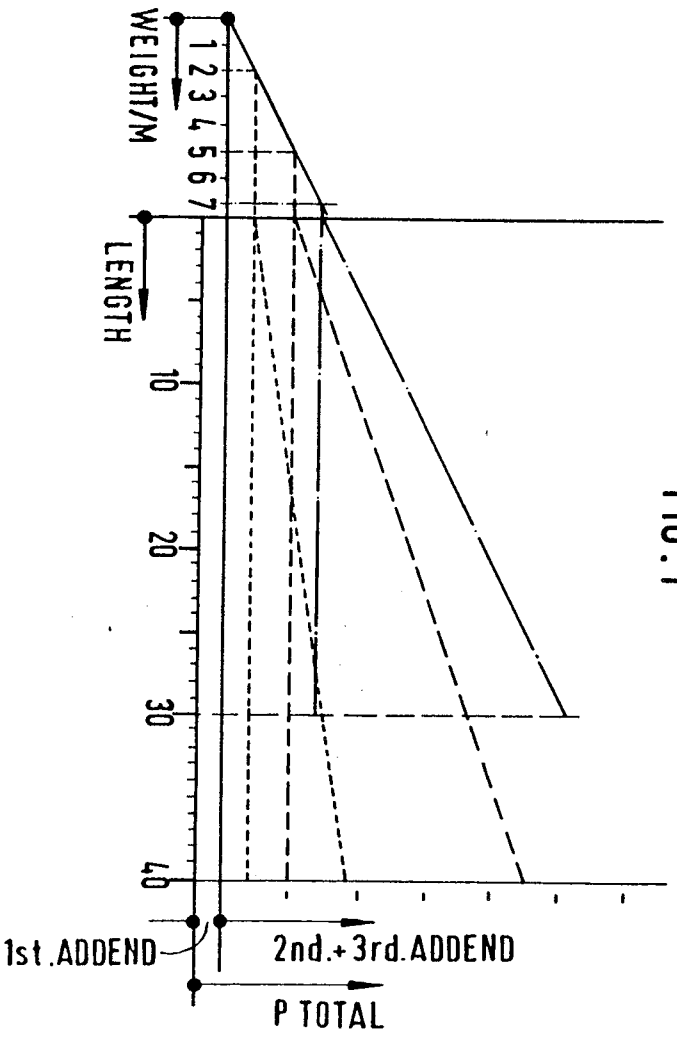
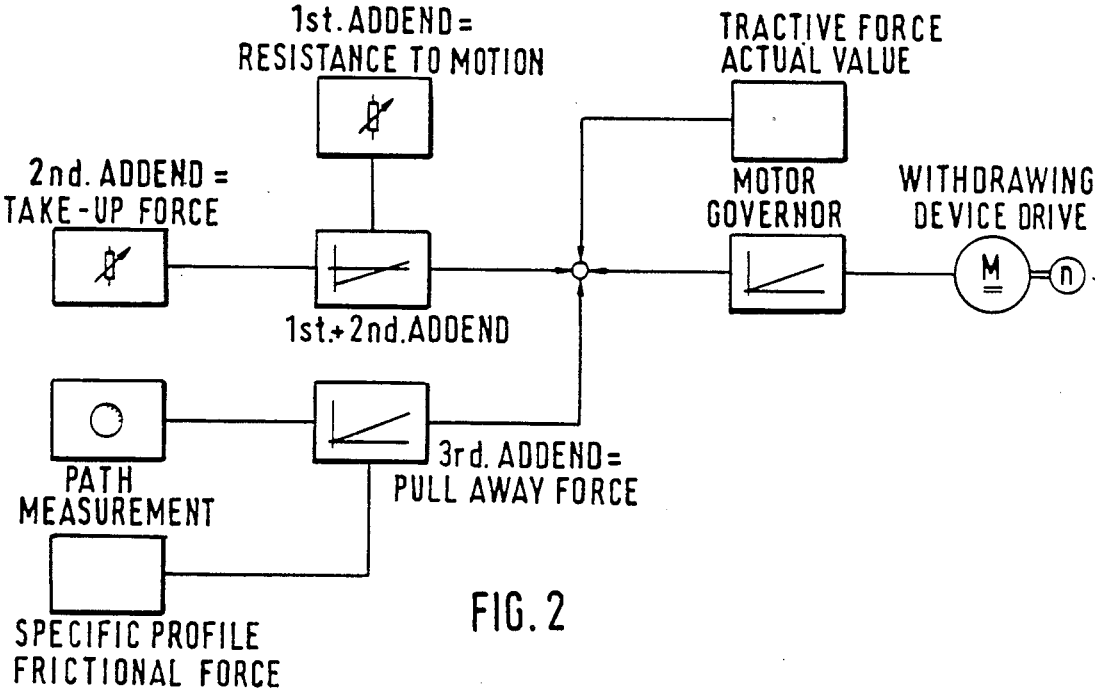
FIG. 2

METHOD FOR TAKING UP A BILLET PRODUCED IN THE EXTRUSION OR TUBE-MAKING PRESS AND CONTROL OF A TAKE-UP DEVICE FOR THIS PURPOSE

CROSS REFERENCE TO RELATED APPLICATION(S)

This United States application stems from PCT International application Ser. No. PCT/DE88/00439 filed Jul. 18,1988.

BACKGROUND OF THE INVENTION

The introduction of a mechanized take-up operation for billets produced in an extrusion or tube-making press gave rise to the requirement of limiting the tractive force which is exerted on the billet and keeps the latter straight so as to prevent any effect on the formation of the billet in the die (DE-PS 484 649). If billets are produced which either cannot or are not intended to be wound up, it is usual to provide a table after the press which receives the emerging billets and guides them during extrusion, with support surfaces, which are as flat as possible, being provided to prevent distortion of the billets during cooling. Owing to the risk of thin billets buckling and the reaction of the shear force on the formation of the billet in the die, resulting in compression of the emerging billet, it is usual to use take-up device consisting of carriages which are moved along the table by a traversing drive and provided with grippers which grip the tips of the emerging billets. However it has to be ensured that the tractive force exerted on a billet by a take-up device does not affect the formation of the billet in the die by causing a contraction in area of the emerging billet. In order to meet the demand for increasingly closer tolerances of the cross-sectional dimensions of the billets, the traversing drives, together with the measurement and control of the tractive force to be exerted on the billets, have been improved in numerous proposals with the result that, by means of a more accurate and direct measurement of the tractive force at the grippers and specially developed tranversing drives, the smallest possible tractive force, which is constant within narrow limits, is sufficient to keep the billets straight and prevent compressive forces from arising in the billet.

BRIEF SUMMARY OF THE INVENTION

An object aim of the invention is to improve the cross-sectional tolerances of the extruded billets taken up from an extrusion press by minimizing the tractive force in the billet, which acts in the area of the die and affects the formation of the billet. In this respect the invention is based on the knowledge that, as the distance between the billet and the die increases, the former may be subjected to an increasing tractive force throughout as a result of cooling, without changes in cross section taking place. According to the invention, when the billet is taken up by a controlled tractive force which does not affect the formation of the billet and keeps the billet straight, the procedure is such that a tractive force (pull-away force) which increases in proportion to the extruded billet length and allows for the unit length weight and coefficient of friction between the billet and the delivery table is superimposed upon a tractive force (take-up force) which is adapted to the cross section and the flow behavior in the die. As the tractive force is increased in accordance with the frictional resistance, which increases with the extruded length, the tractive force in the area of the die can be kept at a constant minimum value which is sufficient to keep the billet straight.

A particular difficulty within the scope of the object and solution according to the invention lies in determining with sufficient accuracy the magnitude of the respective tractive force to be superimposed upon the base value. While the respective length of the extruded billet can be continuously measured in a known manner, the coefficient of friction in particular is subject to considerable variations, which are dependent on the operating conditions, so that a particular and essential further object of the invention is to accurately determine the respective specific frictional force. The procedure according to the invention for achieving this object is such that after each billet has been separated and withdrawn from the die, the force required for pulling it away is measured and, divided by the length of the billet, which is in each case simultaneously determined, serves as a set value of a specific profile frictional force which, multiplied by the respective billet length, is superimposed as the pull-away force upon the base value of the take-up force and on the resistance to motion.

In order to put the method into practice, the take-up device according to the invention is provided with a control in which, in addition to a predetermined value, takes account of the resistance to motion of the carriage of the take-up device, as a first addend, and in addition to a base value—dependent upon the billet cross—of the take-up force as a second addend, starting from the point at which the billet tip is gripped by the grippers of the take-up device, an increasing value, which is the respective product of the result of a continuous delivery path measurement and the predetermined specific profile frictional force between the emerging billet and the delivery table, is determined and entered as a third addend as a desired value for the tractive force exerted on the billet tip.

According to a further feature of the invention, the control is provided such that, starting with the pull-away force determined after the separation of a billet and the withdrawal of the latter from the die as the actual value, account is taken of the length of the billet, a correction value is determined for the specific profile frictional force and entered for the extrusion of the subsequent billet with the same nominal cross section. Variations in the specific profile frictional force, due to operating conditions, are thus continuously determined and corrected.

There may also be variation in the resistance to motion of the withdrawing carriage, with the possibility of an increasing resistance to motion finally rendering the withdrawing force acting on the billet insufficent, so that looping and, in the long run, compression of the billet may occur. In order to prevent this, according to a further feature of the invention the force required just to move the withdrawing carriage before the billet is gripped is measured and entered as a first addend. According to a further feature of the invention, it is also possible to determine the resistance to motion from the difference between the force acting in the cable pulling the withdrawing carriage and the force acting on the gripper and enter it as a first addend.

In order to reliably prevent any compression of the billet under all circumstances, according to a further feature of the invention a device which signals deviations from a straight, loop-free delivery of the billet and thus a reduction in the withdrawing force (second addend of the take-up force) acting on the billet in the area of the die to zero is provided in the area of the counter-crosshead of the press and controls the lower limit of the take-up force.

The invention will now be described in detail in an exemplary embodiment with reference to the accompanying drawings, wherein:

FIG. 1 shows the operating cycle in a graph illustrating the dependency of the withdrawing force on the withdrawn length;

FIG. 2 is a diagram showing the control;

DETAILED DESCRIPTION

Figure 3:
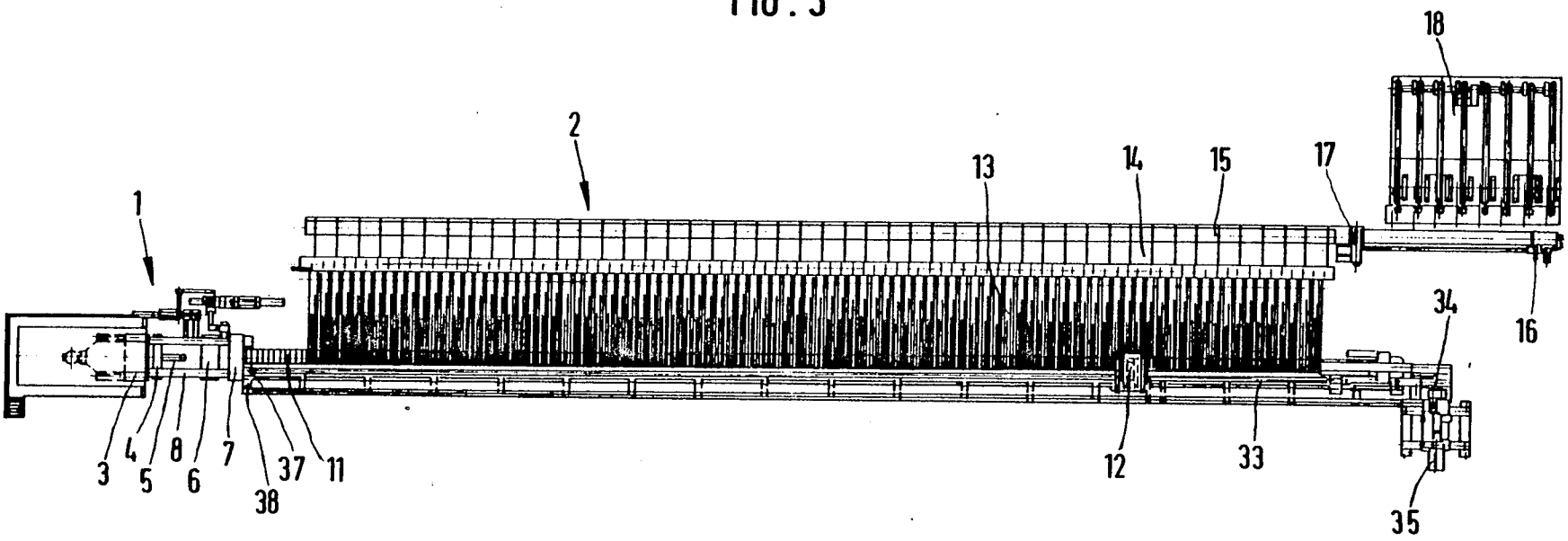
FIG. 3 is a general top plan view of a press with the delivery part.

An apparatus suitable for carrying out the method according to the invention is illustrated in FIG. 3 and consists of an extrusion or tube-making press 1 and a delivery part 2 for the extruded billets.

The illustrated extrusion press 1 consists of a cylinder crosshead 3 with a press cylinder, the moving crosshead 4, which is moved by a plunger and carries the ram 5, a holding part 6 for the metal block which is to be extruded and a counter-crosshead 7 which supports the die and is connected to the cylinder crosshead 3 by tie rods 8.

The delivery part 2 consists of a delivery table 11, which is arranged along the longitudianl axis of the press 1 and along which a withdrawing carriage 12 can move. The extruded and withdrawn profiles are conveyed by rakes in the transverse direction via the cooling bed 13 to a collecting table 14, from where they are conveyed by a roller table 15 in the longitudinal direction until they reach a stop 16, at which time they are divided by a dividing device (shears or saw) 17 into commercial lengths and conveyed in the transverse direction onto a collecting device 18.

Figure 4:
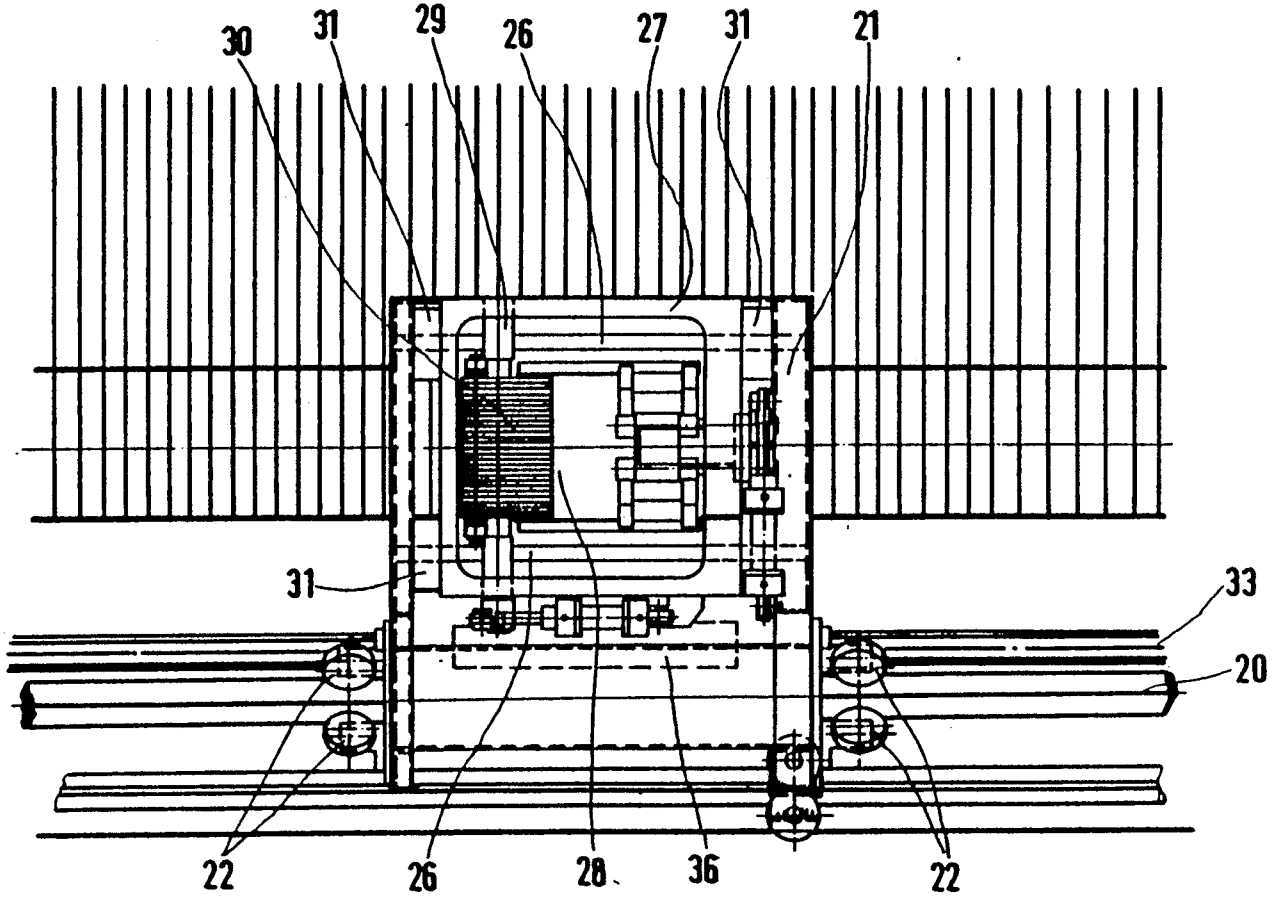
FIG. 4 is a top plan view of a section from FIG. 3 showing the withdrawing carriage on an enlarge scale.
Figure 5:
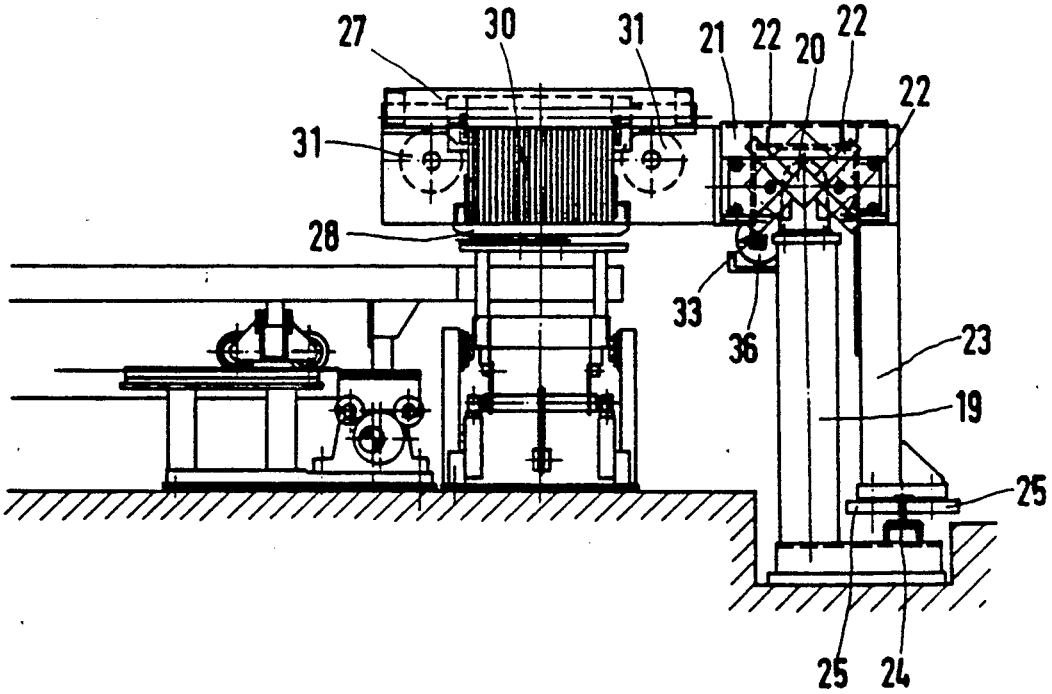
FIG. 5 is a right side elevational view of FIG. 4.
Figure 6:
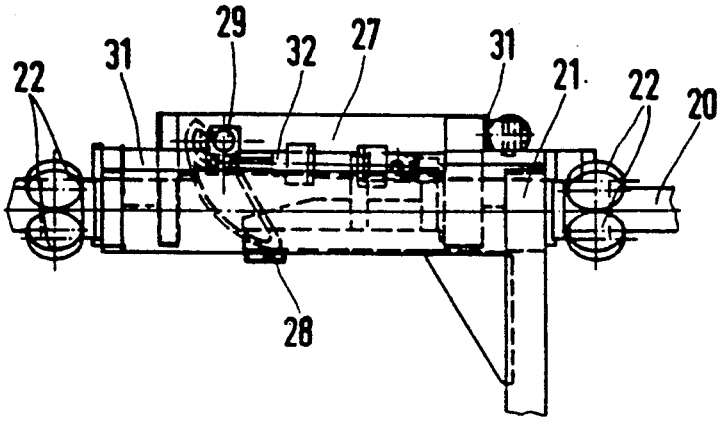
FIG.6 is an elevational view in the direction of movement of the billet.

As can be seen in greater detail from FIGS. 4, 5 and 6, the withdrawing carriage 12 is moved along a rail 20 resting on supports 19. The frame 21, which is open at the bottom in the area of the rail 20, of the withdrawing carriage 12 is provided at both front ends with bearing blocks for the wheels 22 conveying the withdrawing carriage 12 along the rail 20. The withdrawing carriage 12 is conveyed by an arm 23 on a further rail 24 by means of wheels 25 mounted on the arm 23. A gripper 27 can be moved on bars 26 in the withdrawing direction in the frame 21 of the withdrawing carriage 12. The gripper 27 consists of a two-part base plate 28, the halves of which can be swung out to the sides, so that the gripper 27 can be opened at the bottom. Also provided are discs 30, which can be swivelled about an axis 29 and between which and the base plate 28 the profiles which are to be extruded can be gripped by the gripper 27. The gripper 27 is braced with respect to the frame 21 of the withdrawing carriage 12 in the withdrawing direction via pressure pickups 31, so that the tractive force exerted on the profile which is to be extruded is measured by the pressure pickups 31. A piston-cylinder unit 32 is provided in order that the discs 30 can be swung out to release the billet. The withdrawing carriage 12 is moved along the rails 20 and 24 by means of a cable line, consisting of a traction cable 33 and a capstan or winch 34, which is driven by a d.c. motor 35 with adjustable speed and torque. The traction cable 33 is connected to the withdrawing carriage 12 via a traction dynamometer 36, which measures the tractive force at the gripper 27 which is exerted on the billet and the resistance to motion of the withdrawing carriage 12. The resistance to motion of the withdrawing carriage 12 is thus the tractive force measured by the traction dynamometer 36 less the tractive force which is exerted by the gripper 27 on the billet and measured by the pressure pickups 31.

The procedure when extruding and taking up the billet is as follows:

At the beginning of the operation cycle the withdrawing carriage 12 is in readiness directly after the counter-crosshead 7 of the press 1. As soon as the tip of the billet reaches the area of the withdrawing carriage 12 with its gripper 27, the withdrawing carriage 12 is accelerated until it is synchronized with the billet. The resulting resistance to motion of the withdrawing carriage 12 is determined as a component force (first addend) of a tractive force to be applied from the traversing drive (motor 35, capstan or winch 34) by the traction cable 33 (see graph in FIG. 1). As soon as the resistance to motion is determined, the gripper 27 closes upon air entering the piston-cylinder-unit 32, so that the discs 30 descend onto the base plate 28 and thus clamp the tip of the billet.

Taking into account the relative density of the material of the billet, the unit length weight of the billet corresponds to a cross section on which the force with which the billet can be withdrawn without the risk of a contraction in cross section, and thus without any effect on the forming process in the die, again depends. This component force forms the second addend of the tractive force in the traction cable 33 which is to be applied.

The length of the extruded billet is continuously measured by counting pulses from a pulse generator 38, connected to the guide roller 37 for the traction cable 33, and, multiplied by the specific profile frictional force between the billet and the delivery table, applied as a third component value (third addend), which increases in proportion to the billet length, of the tractive force in the traction cable 33 which is to be applied.

After a billet has been extruded, separated from its extrusion residue and expelled or withdrawn from the die, the pull-away force measured at the gripper 27 by the pressure pickups 31 is measured at the same time as the length of the billet which has been pulled away. The pull-away force divided by the billet length corresponds to the actual value of the specific profile frictional force and is taken as a basis for determining the third addend of the tractive force for the subsequent operating cycle when extruding a billet of the same cross section.

In order to determine the tractive force in the traction cable 33, the traction dynamometer 36, which is connected to the traction cable 33, can be replaced by a torque measurement at the winch of the capstan 34 or, together with a rotational speed measurement, a measurement of the power consumption at the motor 35, from which the tractive force in the traction cable 33 can be determined.

As the resistance to motion of the withdrawing carriage 12 does not vary during normal operation, this can be subtracted as a constant from the force ascertained in the traction cable 33 in order to determine the addends 2 (take-up force) and 3 (pull-away force), so that it is unnecessary to provide the pressure pickups 31 or secure the gripper 27 in the withdrawing carriage 12 such that it can move in the withdrawing direction, thus reducing the expenditure on the withdrawing device structure.

As shown by the control diagram illustrated in FIG. 2, the resistance to motion is taken and entered as a 1st addend as the tractive force measured in the traction cable 33 when the withdrawing carriage 12 is synchronized with the emerging billet before the grippers 27 close. This is added to the 2nd addend, which represents the empirically determined take-up force, which is specific to the profile and dependent on the cross section. the 3rd addend is the product of the respective billet length, determined by a path measurement by means of the pulse generator 38, and the specific profile frictional force, this being empirically determined and set for the first extrusion operation and determined and entered for each subsequent extrusion operation by measuring the tractive force required to pull away the extruded billet after it has been separated from the extrusion redsidue and left the die and dividing this measured value by this billet length, which is also measured. The resulting 3rd addend is added to the sum of the 1st and 2nd addends to give the respective desired value of the tractive force, and the torque of the motor for driving the withdrawing device is adjusted by a motor governor on the basis of a comparison with the respective actual value of the tractive force.

We claim:

1. A method for taking up a billet produced in an extrusion or tube making press with a controlled tractive force while maintaining the billet straight and without affecting the formation of the billet in a die of the press comprising:

applying a pull-away tractive force to the billet;

increasing said pull-away tractive force in proportion to the billet length, weight per unit length of the billet and coefficient of friction between the billet and a delivery table for receiving the billet;

determining the take-up tractive force dependent on the cross-section and flow characteristics in the die; and superimposing said pull-away tractive force on said take-up tractive force for determining the desired tractive force to be exerted on the billet.

2. A method for taking up a billet produced in an extrusion or tube making press with a controlled tractive force while maintaining the billet straight and without affecting the formation of the billet in a die of the press comprising:

applying a pull-away tractive force to the billet;

increasing said pull-away tractive force in proportion to the billet length, weight per unit length of the billet and coefficient of friction between the billet and a delivery table for receiving the billet;

determing the take-up tractive force dependent on the cross-section and flow characteristics in the die;

superimposing said pull-away tractive force on said take-up tractive force for determining the desired tractive force to be exerted on the billet;

separating and withdrawing said billet from the die;

after said separating and withdrawing, measuring said pull-away force, and measuring the length of the emerging billet by a path measurement;

dividing said measured pull-away force by said billet length to determine a set value for the specific profile friction force; and entering said set value multiplied by the billet length when extruding a subsequent billet having the same nominal cross-section.

3. Control for keeping constant force acting in the area of the die on the billet emerging from extrusion or tube-making press, characterised in that, in addition to a pretermined value, which takes account of the resistance to motion of a carriage of a take-up device, as a first addend, and in addition to a base value—dependent upon the billet cross section—of the take-up force as a second addend, starting from the point at which the billet tip is gripped by grippers of the take-up device, an increasing value, which is the respective product of the result of a continuous delivery path measurement and a predetermined specific profile frictional force between the emerging billet and a delivery table, is determined and entered as a third addend as a desired value of the tractive force exerted on the billet tip.

4. Control according to claim 3, characterised in that, starting with the pull-away force determined after the separation of the billet and the withdrawal of the latter from the die as a actual value, taking account of the length of the billet, a correction value is determined for the specific profile frictional force and entered.

5. Control according to claim 3, characterised in that the force required just to move the withdrawing carriage before the billet is gripped is measured and entered as a first addend.

6. Control according to claim 3, characterised in that the force acting in the cable pulling a withdrawing carriage and the force acting on the gripper are measured and the difference between these forces is entered as a first addend (resistance to motion).

7. Control according to claim 3, characterised in that a device which signals deviations from a straight, loop-free delivery of the billet and thus a reduction in the second addend of the take-up force to zero is provided in the area of a counter-crosshead of a press and controls the lower limit of the take-up force.

8. Control according to claim 3, characterised in that the desired value, as compared with the actual value, of the tractive force measured at the withdrawing device serves as a controlled variable and the torque of a d.c. motor driving a cable winch for the withdrawing device, which consists of the carriage and grippers, is adjusted as a function of this.

9. An apparatus for controlling the force acting in the area of an extrusion die on a billet emerging therefrom to maintain said force substantially constant, said apparatus comprising movable means supporting and gripping a billet to withdraw the billet from the die, and means exerting a controlled force on said movable means to exert a substantially constant force on the billet, said means exerting a controlled force being responsive to the resistance to motion of the movable means as a first input, a force dependent upon the billet cross section as a second input and an increasing force resulting from the product of a continuous measurement of the length of the billet as it moves in a delivery path and the profile frictional force between the emerging billet and the movable means as a third input.

* * * * *